US007486917B2

(12) United States Patent
Akita

(10) Patent No.: US 7,486,917 B2
(45) Date of Patent: Feb. 3, 2009

(54) IMAGE-FORMING APPARATUS

(75) Inventor: Masanori Akita, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 223 days.

(21) Appl. No.: 11/672,876

(22) Filed: Feb. 8, 2007

(65) Prior Publication Data

US 2007/0196139 A1 Aug. 23, 2007

(30) Foreign Application Priority Data

Feb. 23, 2006 (JP) ..... 2006-047573

(51) Int. Cl.
*G03G 15/09* (2006.01)

(52) U.S. Cl. ..... 399/277

(58) Field of Classification Search ..... 399/252, 399/265, 266, 267, 277, 290
See application file for complete search history.

(56) References Cited

U.S. PATENT DOCUMENTS 6,841,327 B2 * 1/2005 Otake et al. ..... 430/123.3
7,272,347 B2 * 9/2007 Yamashita et al. ..... 399/267

FOREIGN PATENT DOCUMENTS

EP 1533659 A2 5/2005
JP 61-160764 B 7/1986
JP 1-092759 A 4/1989
JP 5-035038 A 2/1993
JP 8-220821 A 8/1996
JP 2003-280460 A 10/2003

* cited by examiner

*Primary Examiner*—Hoan H Tran
(74) *Attorney, Agent, or Firm*—Canon U.S.A., Inc. I.P. Division

(57) ABSTRACT

An image-forming apparatus includes a first developer container accommodating a first developing agent containing a dark-colored toner and a first carrier; a first developing agent-bearing member at the first developer container, that transports the first developing agent to a first developing region; a first unit for generating a magnetic field in the first developing region, disposed in the first developing agent-bearing member; a second developer container accommodating a second developing agent containing a light-colored toner and a second carrier; a second developing agent-bearing member at the second developer container, that transports the second developing agent to a second developing region; and a second unit for generating a magnetic field in the second developing region and disposed in the second developing agent-bearing member. Magnetic binding force applied to the second carrier in the second developing region from the second unit is larger than that to the first carrier from the first unit.

7 Claims, 8 Drawing Sheets

IMAGE-FORMING APPARATUS

BACKGROUND OF THE INVENTION

1. Field of the Invention

The present invention relates generally to image-forming apparatuses that develop an electrostatic image with a two-component developing agent containing a toner and a carrier. In particular, the present invention relates to an image-forming apparatus that forms an image using dark-colored toners and light-colored toners.

2. Description of the Related Art

A color image-forming apparatus that forms a multicolor image, such as a full color image, with toners of different colors has been widely used as an electrophotographic image-forming apparatus.

The requirements for image-forming apparatuses have become more stringent with advancement of the technology. There have been proposed image-forming apparatuses that use more colors than conventional four colors. For example, a technique widely employed in inkjet printing uses light-colored toners, such as a light cyan toner and a light magenta toner, in addition to common cyan, magenta, yellow, and black toners (see Japanese Patent Laid-Open No. 5-35038). Furthermore, there is a technique that uses a transparent toner in addition to the toners of four colors (see Japanese Patent Laid-Open No. 8-220821).

The main objective for adding light-colored toners is to form higher quality pictures by reducing dotted texture. The principle of forming an image using dark-colored toners and light-colored toners is described below by taking a cyan toner as an example.

FIG. 6 is a graph showing covering power of a light cyan toner (referred to as "LC toner" hereinafter") indicated by a broken line and covering power of a dark cyan toner (referred to as "DC toner" hereinafter) indicated by a solid line. For example, the optical density of the LC toner is 0.7 when the amount of the toner loaded on a transfer material is 0.5 $mg/cm^2$, and the optical density of the DC toner is 1.4 when the amount of the toner loaded on a transfer material is 0.5 $mg/cm^2$. Based on a lookup table (LUT) for the LC toner shown in FIG. 7A and a lookup table (LUT) for the DC toner shown in FIG. 7B, an image is formed, (electrostatic image (latent image) based on the LUT is developed) using the LC toner and the DC toner. Note that the abscissa in each of FIGS. 7A and 7B indicates tone levels (levels 0 to 255) of the image before the image is divided into plates for the DC toner (dark-colored toner) and the LC toner (light-colored toner) (plate division). The ordinate in each graph shows the tone level (levels 0 to 255) after the plate division.

The phrase "image is divided into plates (plate division)" means to divide a set of image data of a particular color (also referred to as plate or channel) into two sets of image data for a dark-colored toner and a light-colored toner, respectively.

As shown in FIG. 8, the tone of cyan faithful to an image signal can be reproduced by superimposing the LC toner image and the DC toner image.

Although the principle of image formation has been described above using a dark cyan toner and a light cyan toner, substantially the same technique is employed in forming an image with a dark-colored toner and a light-colored toner of a color phase other than cyan.

Unlike image formation with a single dark-colored toner, the density per unit dot can be decreased and the dotted texture can be reduced by using a light-colored toner particularly for a low to intermediate-density portion of the image signal.

In general, a two-component development method in which a two-component developing agent mainly containing nonmagnetic toner particles (toner) and magnetic carrier particles (carriers) and a one-component development method in which no carrier is used are known as development methods employed in electrophotography. Image-forming apparatuses that use light-colored toners have an emphasis on image quality and thus frequently employ a two-component development method from the standpoints of high resolution and stabilizing the amount of loaded toner.

In a two-component development method, since the carrier comes into contact with an image-bearing member, a phenomenon called "carrier adhesion", i.e., adherence of the carrier which is supposed to stay inside a developer onto the image-bearing member, sometimes occurs. There are two types of carrier adhesion: carrier adhesion outside the image region and carrier adhesion inside the image region. In particular, carrier adhesion inside the image region causes image failures such as voids caused by difficulty of transferring the toner around the carrier in a transfer unit and micro fixing defects (micro nonuniformity in gloss levels) caused by difficulty of fixing the toner around the carrier in a fixing unit. Accordingly, carrier adhesion inside the image region is more problematic than carrier adhesion outside the image region.

For example, Japanese Patent Laid-Open Nos. 61-160764 and 1-92759 each disclose a technique of overcoming the problem of carrier adhesion by increasing the magnetic binding force between the carrier and a developing magnetic pole of a magnet fixed inside a developing agent-bearing member in a developer.

However, when the magnetic binding force between the developing magnetic pole and the carrier increases, the magnetic binding force between carrier particles on the developing agent-bearing member also increases, which increases the strength of the carrier chains. As a result, the image on the image-bearing member is easily disturbed as the carrier chains contact the image, and there is a risk of image failures such as roughness (dotted texture) in the low-density portion.

Due to this reason, existing color image-forming apparatuses mainly using yellow, magenta, cyan, and black use a magnetic binding force within an extent that does not cause image failures such as roughness while minimizing carrier adhesion.

It should be noted here that Japanese Patent Laid-Open No. 2003-280460 teaches a structure including a two-component developing unit containing a coloring agent and another two-component developing unit not containing a coloring agent per electrostatic latent image-bearing member. For one electrostatic image, the region outside the image region is developed by the developing unit not containing a coloring agent and the image region is developed by the developing unit containing a coloring agent. Adhesion of the carrier outside the image region is avoided by making the particle diameter of the carrier of the developing agent not containing a coloring agent larger than the particle diameter of the carrier of the developing agent containing the coloring agent.

However, an image-forming apparatus that uses a light-colored toner and a dark-colored toner has suffered from the following problem. When the same type of carrier is used in developing agents of all colors, the frequency of carrier adhesion in the image region is sometimes significantly higher in a developer using a light-colored toner than in a developer using a dark-colored toner. The reason therefor is as follows.

The mechanism of carrier adhesion onto the image region will now be described with reference to FIGS. 9 and 10. FIG. 9 is a schematic diagram of a developing unit (developing region) of a developer. FIG. 10 shows latent image potentials during formation of a solid image (image with the maximum density level) by reversal printing.

FIG. 9 schematically shows a photosensitive drum 1 that functions as an image-bearing member, a developing sleeve 41 that functions as a developing agent-bearing member, a magnet 42 that functions as means for generating a magnetic field, toner particles, and carrier particles. The magnet 42 has a developing magnetic pole S1 in a developing region D between the photosensitive drum 1 and the developing sleeve 41 opposing each other. Herein, the case in which an electrostatic image formed on a negatively charged photosensitive drum 1 is reversely developed with a negatively chargeable toner is described as an example.

During formation of a solid image, a latent image potential shown in FIG. 10 is formed on the photosensitive drum 1. A negatively charged toner is supplied onto the photosensitive drum 1 due to the potential difference $V_{cont}$ between the potential (Vdc) of the developing sleeve 41 and the potential of the exposed region (VL).

Meanwhile, inside the carrier chain exposed to the potential difference, negative charges are injected at ends of the carrier chains by the voltage difference Vcont. If negative potentials are accumulated in the carrier in a predetermined amount or more, the negatively charged carrier particles will adhere on the photosensitive drum 1 due to the force of the electric field in the same manner as in a typical developing process using a toner.

Thus, carrier adhesion onto the image region tends to frequently occur during the development of a high-density toner image with a large potential difference Vcont. As a consequence, the frequency of carrier adhesion onto the image region during the development with a light-colored toner becomes higher than that during the development with a dark-colored toner, as described below.

That is, as previously described, image formation using a light-colored toner and a dark-colored toner is conducted based on the lookup tables (LUTs) shown in FIGS. 7A and 7B. For a typical average operational density (e.g., an average density of 100 to 140 in an image signal levels of 0 to 255), the level of the image output signal for the light-colored toner is 200 to 255, which is equivalent to high-density development for forming a solid image. In other words, the potential difference Vcont in this case is relatively large.

In contrast, the level of the image output signal of the dark-colored toner for the typical average operation density described above is equal to the level for low-density development. In other words, the potential difference Vcont in this case is relatively small.

Therefore, in forming an image with an average density, the possibility of carrier adhesion on the image region during the development with a light-colored toner is several times greater than that during the development with a dark-colored toner.

It should be noted that the amount of the toner loaded to form a light-colored toner image having an average density can be decreased by decreasing the output level of an intermediate portion of the image signal in the lookup table for the light-colored toner. In this manner, it is possible to decrease the frequency of toner adhesion on the image region during development with the light-colored toner. However, in such a case, the original advantage of using the light-colored toner, i.e., to decrease the dotted texture in the low-density portion, is impaired.

SUMMARY OF THE INVENTION

The present invention provides an image-forming apparatus that can prevent carrier adhesion without impairing image quality in forming an image using a light-colored toner and a dark-colored toner having the same hue.

In particular, the image forming apparatus includes a first developer container accommodating a first developing agent containing a first toner and a first carrier; a first developing agent-bearing member that is associated with the first developer container and carries and transports the first developing agent to a first developing region to develop an electrostatic image; a first magnetic field-generating unit generating a magnetic field in the first developing region, the first magnetic field-generating means being disposed in the first developing agent-bearing member; a second developer container accommodating a second developing agent containing a second toner and a second carrier, the second toner having the same hue as that of the first toner but a density lower than that of the first toner; a second developing agent-bearing member that is associated with the second developer container and carries and transports the second developing agent to a second developing region to develop an electrostatic image; and a second magnetic field-generating unit generating a magnetic field in the second developing region, the second magnetic field-generating means being disposed in the second developing agent-bearing member. The magnetic binding force applied to the second carrier in the second developing region from the second magnetic field-generating unit is larger than the magnetic binding force applied to the first carrier in the first developing region from the first magnetic field-generating unit.

Further features of the present invention will become apparent from the following description of exemplary embodiments (with reference to the attached drawings).

DESCRIPTION OF THE EMBODIMENTS

Embodiments of an image-forming apparatus of the present invention will now be described in further detail with reference to the attached drawings.

First Exemplary Embodiment

[Overall Structure and Operation of Image-forming Apparatus]

Figure 1:
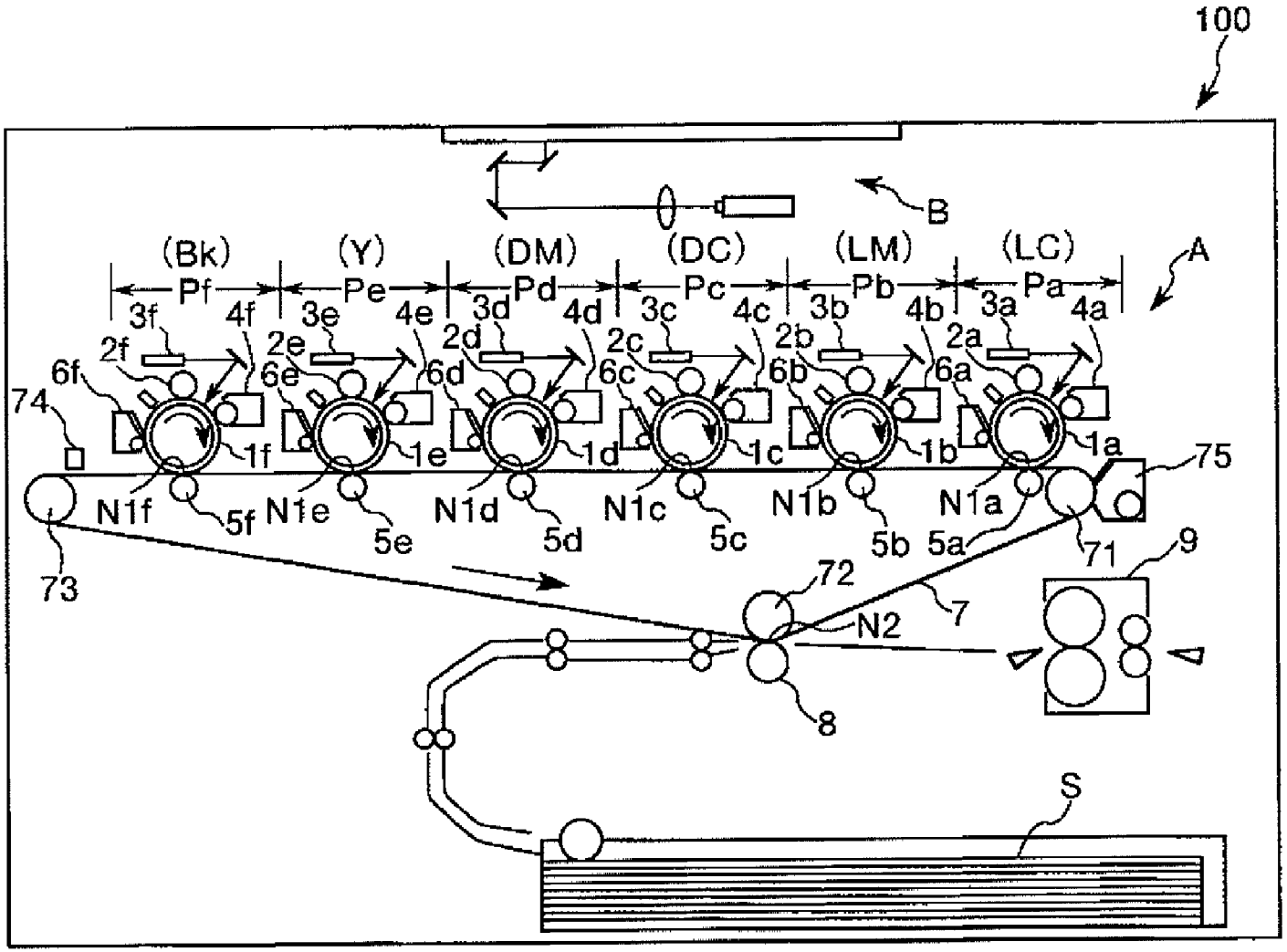
FIG. 1 is a schematic cross-sectional view of an embodiment of an image-forming apparatus of the present invention.

FIG. 1 is a schematic cross-sectional view of a first embodiment of an image forming apparatus of the present invention. An image-forming apparatus 100 of the first embodiment can electrophotographically form a full color image on a transfer material S, e.g., a recording paper sheet or an overhead projector (OHP) sheet, corresponding to an image data signal. The image-forming apparatus 100 of this embodiment employs a tandem method, reversal development method, intermediate transfer method, thermal compression fixing method, and the like widely known among skilled persons.

The image-forming apparatus 100 includes a printer unit A and a reader unit B. In the reader unit B, an image on a document placed on a document table is optically read and converted into color-separated electrical signals, which are sent to the printer unit A. The printer unit A forms a full color image, for example, according to these image data signals.

The printer unit A includes a first to sixth image forming stations Pa, Pb, Pc, Pd, Pe, and Pf. The stations Pa to Pf respectively have image-bearing members 1*a* to 1*f*. The image-bearing members 1*a* to 1*f* are respectively provided with developers 4*a* to 4*f* containing developing agents including toners of different spectral characteristics. The stations Pa to Pf respectively including the image-bearing members 1*a* to 1*f* and the developers 4*a* to 4*f* are serially arranged in the direction of the movement of the surface of an intermediate transfer belt 7 functioning as an intermediate transfer material.

In this embodiment, the first station Pa uses a low-density cyan (LC) toner and the second station Pb uses a low-density magenta (LM) toner to form an image. The third to sixth stations Pc to Pf respectively use high-density toners of cyan (DC), magenta (DM), yellow (Y), and black, (Bk) to form an image.

In the description below, unless otherwise necessary, the components common to all colors are referred to by reference numerals without lower case letters a, b, c, d, e, and f that distinguish the individual units according to the color.

A drum-shaped photosensitive member (photosensitive drum) 1 serving as an image-bearing member is supported while being made rotatable in the direction indicated by the arrow in the drawing. A charger (charging roller) 2 serving as charging means, a laser exposure optical system (exposure apparatus) 3 serving as exposing means, a developer 4 serving as developing means, a primary transfer roller 5 serving as primary transfer means, a cleaner 6 serving as cleaning means, and other associated components are disposed around the photosensitive drum 1.

The intermediate transfer belt 7 serving as an intermediate transferring member faces all of the photosensitive drums 1*a* to 1*f* of the first to sixth stations Pa to Pf. The intermediate transfer belt 7 is stretched across a driving roller 71, a secondary transfer counter roller 72, and a driven roller 73. The intermediate transfer belt 7 undergoes endless motion (revolving motion) in the direction indicated by the arrow in the drawing as the rotary drive force is transmitted to the driving roller 71. Primary transfer rollers 5*a* to 5*f* respectively facing the photosensitive drums 1*a* to 1*f* of the stations Pa to Pf are provided at the inner-periphery-side of the intermediate transfer belt 7. The primary transfer rollers 5*a* to 5*f* are in contact with the intermediate transfer belt 7, which is pressed against the photosensitive drums 1*a* to 1*f*. In this manner, primary transfer portions (primary transfer nips) N1*a* to N1*f* at which the intermediate transfer belt 7 contacts the photosensitive drums 1*a* to 1*f* are formed. A secondary transfer roller 8 pressed against the secondary transfer counter roller 72 with the intermediate transfer belt 7 therebetween is also provided. A secondary transfer portion (secondary transfer nip) N2 is thereby formed at a position where the secondary transfer roller 8 contacts the intermediate transfer belt 7.

During formation of an image, the photosensitive drum 1 is rotated in the direction of the arrow in the drawing to uniformly charge the surface of the rotating photosensitive drum 1 with the charger 2. An optical image according to image data of a separated color corresponding to each station P is projected from the exposure apparatus 3 onto the photosensitive drum 1 to form an electrostatic image (latent image) thereon. Subsequently, the electrostatic image on the photosensitive drum 1 is reversely developed with the developer 4 to form a toner image composed of a resin and a pigment on the photosensitive drum 1. During this process, a developing bias is applied to the developer 4. The toner image formed on the photosensitive drum 1 is transferred (primary transfer) onto the intermediate transfer belt 7 by the primary transfer roller 5. During this process, a primary transfer bias is applied to the primary transfer roller 5.

Figure 7A:
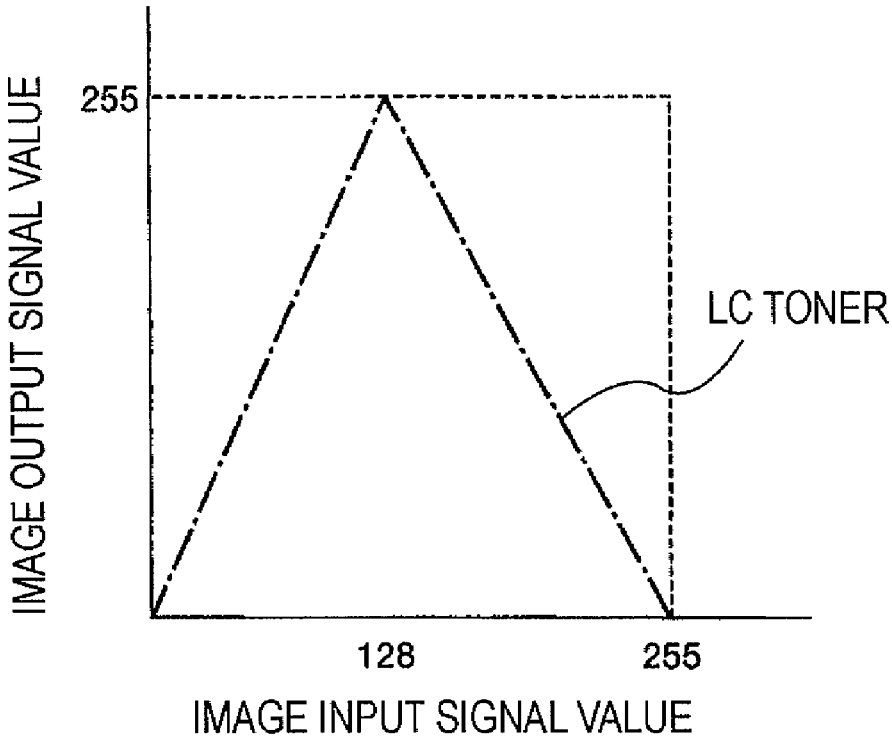
FIG. 7A (PRIOR ART)
FIG. 7A is a graph showing a lookup table for the LC toner and FIG. 7B is a graph showing a lookup table for the DC toner.
Figure 7B:
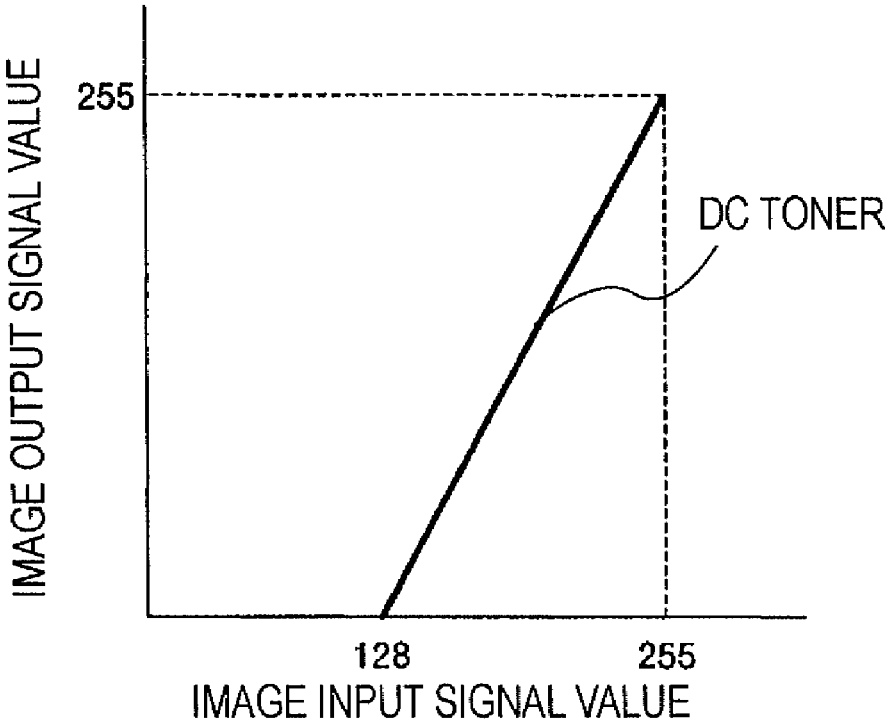
FIG. 7B (PRIOR ART)
Figure 8:
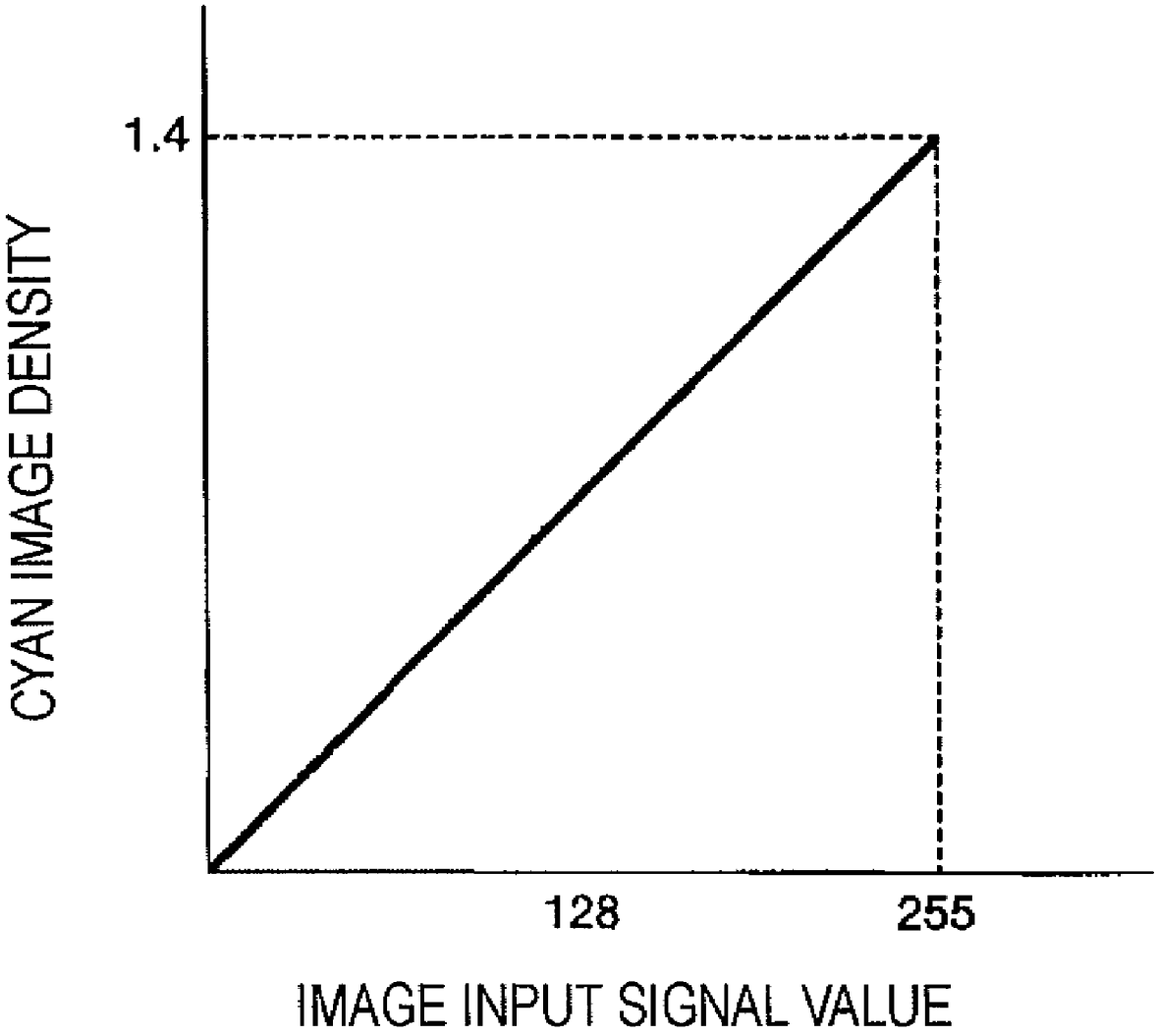
FIG. 8 (PRIOR ART)
FIG. 8 is a graph showing density of cyan and an image input signal.
Figure 9:
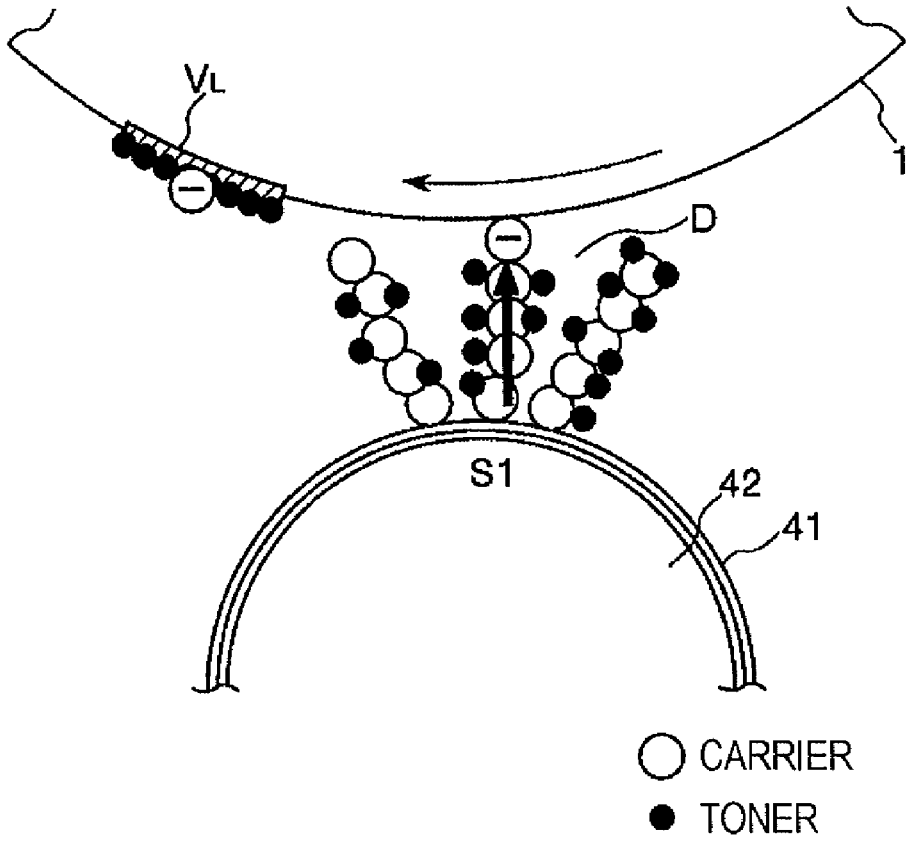
FIG. 9 (PRIOR ART)
FIG. 9 is a schematic diagram of a developing region.
Figure 10:
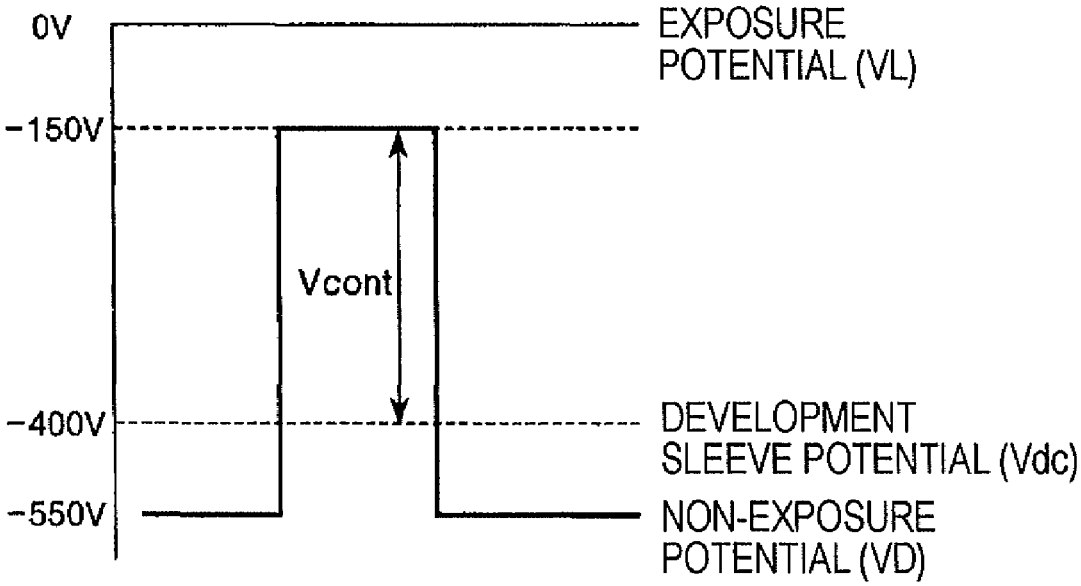
FIG. 10 (PRIOR ART)
FIG. 10 is a graph for explaining latent image potentials during image-forming by reverse development.

Formation of images using the LC toner and the DC toner is conducted based on the lookup tables for the LC and DC toners shown in FIGS. 7A and 7B, as described above. The LC toner image and the DC toner image are then superimposed to reproduce cyan gradation faithful to the image signal, as shown in FIG. 8. The same applies for the image formation using the LM toner and the DM toner.

Formation of an image using only a dark-colored toner such as a Y or Bk toner is conducted according to a lookup table that relates the output image density with the input signal shown in FIG. 8 for the corresponding color.

For example, in order to form a full color image, the above-described operation is conducted in all of the first and sixth stations Pa to Pf. In this manner, toner images are sequentially stacked on the intermediate transfer belt 7 at the first transfer portions N1*a* to N1*f* to thereby form a primarily transferred full color toner image.

The full color toner image on the intermediate transfer belt 7 is then transferred (secondary transfer) onto a sheet of paper, i.e., a transfer material S. During this process, a secondary transfer bias is applied to the secondary transfer roller 8.

The transfer material S is fed from a storage unit one sheet at a time to the secondary transfer portion N2 at a desired timing.

The transfer material S onto which a toner image is transferred at the secondary transfer portion N2 passes through a transporting unit and fed to a heat-roller fixing unit 9. The toner image is fixed to the transfer material S in the heat-roller fixing unit 9, and the transfer material S is discharged in a discharge tray or a post-treatment device (not shown).

The toner remaining on the photosensitive drum 1 after the primary transfer step is collected by the cleaner 6. The toner remaining on the intermediate transfer belt 7 after the secondary transfer step is collected by a belt cleaner 75 serving as cleaning means for cleaning the intermediate transfer material.

Of the rollers that stretch the intermediate transfer belt 7 to form a transfer surface onto which the toner images are transferred from the photosensitive drums 1*a* to 1*f*, the driven roller 73 located downstream in the moving direction of the intermediate transfer belt 7 opposes a sensor 74. The sensor 74 detects displacement and density of the images transferred onto the intermediate transfer belt 7 from the photosensitive drums 1*a* to 1*f*. The controller (not shown) of an integrated controlling unit for controlling the image-forming apparatus corrects image density, toner supply amount, timing for writing an image, position to start writing an image, etc., of each of the stations Pa to Pf based on the results detected by the sensor 74.

Figure 2:
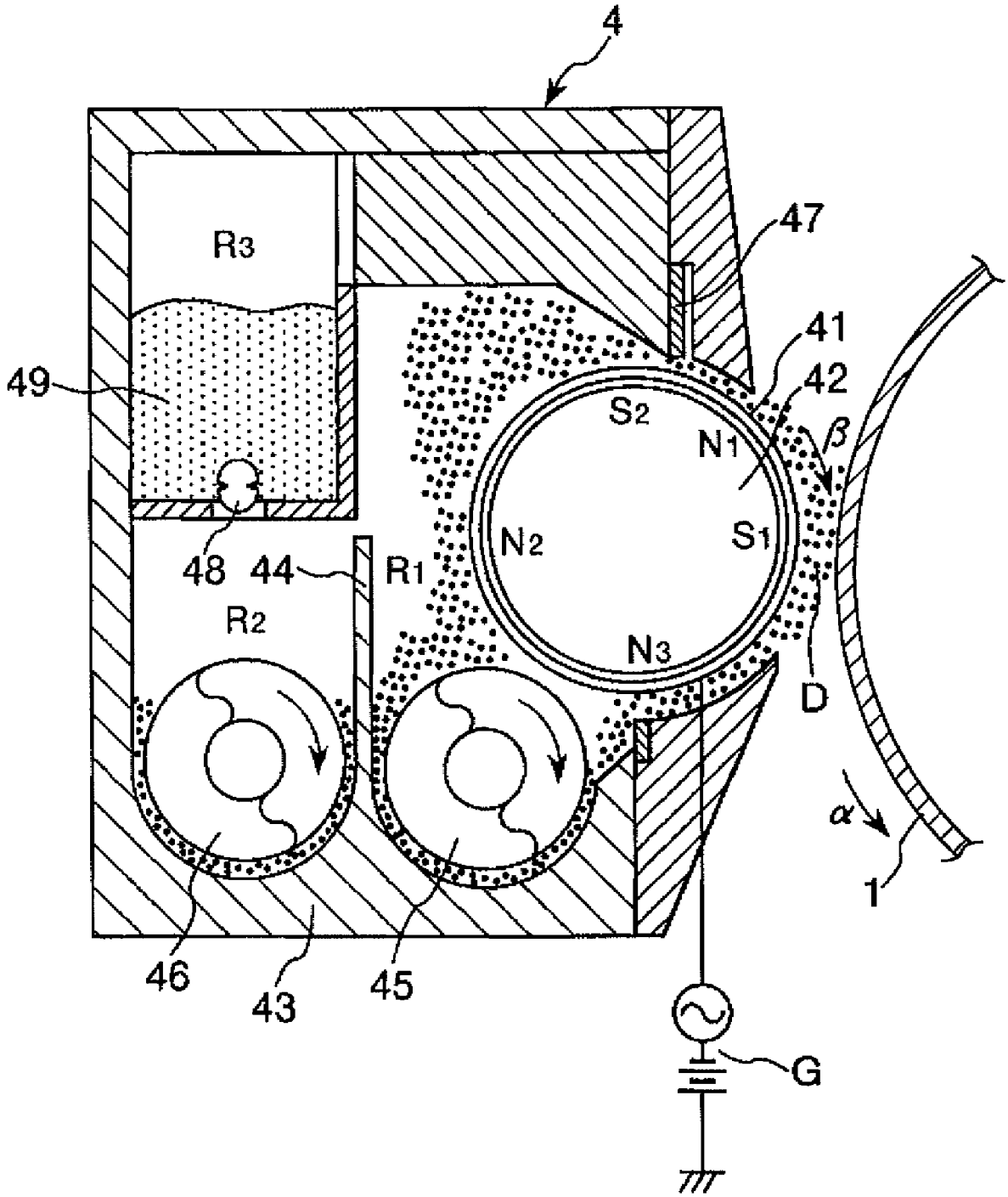
FIG. 2 is a schematic cross-sectional view of a developing unit in the image-forming apparatus of FIG. 1.

Referring now to FIG. 2, the developer 4 for developing a dot-distributed electrostatic image formed on the photosensitive drum 1 is explained in further detail. It should be noted that in this embodiment, as will be described in detail below, all of the developers 4*a* to 4*f* are substantially the same except for the carrier in the developing agent used.

The developer 4 has a developer container (main unit of the developer) 43. The interior of the developer container 43 is divided into a development chamber (first chamber) $R_1$ and a mixing chamber (second chamber) $R_2$ by a wall 44. A toner reservoir $R_3$ is disposed above the mixing chamber $R_2$, and contains a supplemental toner (nonmagnetic toner particles) 49. The toner reservoir $R_3$ has a supply port 48. The supplemental toner in an amount equal to the toner consumed by development falls into the mixing chamber $R_2$ through the supply port 48. The development chamber $R_1$ and the mixing chamber $R_2$ each contain a two-component developing agent mainly including nonmagnetic toner particles (toner) and magnetic carrier particles (carrier).

A first transporting screw 45 that serves as means for mixing and transporting the developing agent is placed inside the development chamber $R_1$. As the first transporting screw 45 is rotated, the developing agent inside the development chamber $R_1$ is transported in the longitudinal direction of the developing sleeve 41 serving as a developing agent-bearing member described below.

A second transporting screw 46 that serves as means for mixing and transporting the developing agent is placed inside the mixing chamber $R_2$. As the second transporting screw 46 is rotated, the developing agent is transported in the longitudinal direction of the developing sleeve 41. The direction of transportation of the developing agent by the second transporting screw 46 is opposite to that by the first transporting screw 45.

The wall 44 has a hole in each end in the longitudinal direction (direction parallel to the axial direction of each screw). The developing agent transported by the first transporting screw 45 is delivered to the second transporting screw 46 through one of these holes, and the developing agent transferred by the second transporting screw 46 is delivered to the first transporting screw 45 through the other hole. In this manner, the developing agent is circulated and transported inside the developer container 43.

In order to keep the toner density (toner content, i.e., weight ratio of the toner to the entire weight of the developing agent) in the developer 4 to a constant level, the supplemental toner 49 is supplied from the toner reservoir $R_3$ to the mixing chamber $R_2$ at desired timing during formation of an image. The supplemental toner 49 is supplied to the toner reservoir $R_3$ from a supplemental toner container (not shown) of each color as needed.

An opening is formed in the developer container 43 in a position near the photosensitive drum 1. A cylindrical member composed of a nonmagnetic material such as aluminum, nonmagnetic stainless steel, or the like is disposed in this opening. This cylindrical member is the developing sleeve 41 that serves as a developing agent-bearing member.

The developing sleeve 41 rotates in the direction of arrow β in the drawing and carries and transports the developing agent containing the toner and the carrier to the developing region D where the photosensitive drum 1 opposes the developing sleeve 41. The photosensitive drum 1 rotates in the direction of arrow α in the drawing. In other words, the developing sleeve 41 and the photosensitive drum 1 rotate such that their surfaces move in the same direction at the developing region D.

The standing chains (magnetic brush) of the developing agent carried on the developing sleeve 41 contact the photosensitive drum 1 at the developing region D to develop the electrostatic image on the photosensitive drum 1 at the developing region D.

It should be noted here that a vibration bias voltage in which an AC voltage and a DC voltage are superimposed is supplied to the developing sleeve 41 from a developing bias generator G which serves as means for outputting a developing bias. The dark potential (potential of the non-exposed portion) VD and the light potential (potential of the exposed portion) VL of the electrostatic image are present between the maximum value and the minimum value of the vibration bias voltage. In this manner, an alternating electric field in which the orientation changes in an alternating fashion is formed in the developing region D. The toner and the carrier are rigorously vibrated in the alternating electric field, and the toner adheres onto the photosensitive drum 1 along the electrostatic image as the vibrating toner breaks the electrostatic binding force from the developing sleeve 41 and the carrier.

The difference between the maximum value and the minimum value of the vibration bias voltage is preferably in the range of 0.5 kV to 2 kV, and the frequency is preferably in the range of 1 kHz to 12 kHz. The waveform of the vibration bias voltage may be rectangular, sine, triangular, or the like. The value of the DC voltage component of the vibration bias voltage is between the dark potential VD and the light potential VL of the electrostatic image. In order to prevent toner adhesion onto the dark potential region that causes fogging, the DC voltage component is preferably closer to the dark potential VD than the light potential VL, which has the smallest absolute value. In this embodiment, the peak-to-peak voltage is set to 1.5 kV and the frequency is set to 12 kHz in all of the developers 4.

The minimum space between the developing sleeve 41 and the photosensitive drum 1 (this minimum space is located in the developing region D) is preferably in the range of 0.2 mm to 1 mm. In this embodiment, the minimum space is set to 0.4 mm in all of the developers 4 so that the two-component developing agent transported to the developing region D contacts the photosensitive drum 1 during development.

A developing blade 47 that serves as a member for regulating the thickness of the developing agent is disposed upstream of the developing region D in the rotation direction of the developing sleeve 41 so that the developing blade 47 opposes the developing sleeve 41. The developing blade 47 regulates the thickness of the two-component developing agent carried and transported by the developing sleeve 41 to the developing region D. The amount of the developing agent (coating amount of the developing agent) transported to the developing region D while being regulated by the developing sleeve 41 is set to be about the same in all of the developers 4. In this embodiment, the coating amount of the developing agent per unit area of the developing sleeve 41 is regulated to 30 mg/cm$^2$.

A roller magnet 42 serving as magnetic field generating means is fixed in the developing sleeve 41. The roller magnet 42 has the developing magnetic pole S1 opposite to the developing region D. A developing magnetic field formed by the developing magnetic pole S1 in the developing region D forms a magnetic brush before development, and the magnetic brush contacts the photosensitive drum 1 to develop the dot-distributed electrostatic image. During the development, the toner adhering the chains of the magnetic carrier and the toner adhering on the surface of the developing sleeve 41 are transferred to the exposed regions of the electrostatic image of on the photosensitive drum 1 to develop the image. In this embodiment, the intensity of the developing magnetic field by the developing magnetic pole S1 on the surface of the developing sleeve 41 (magnetic flux density in a direction perpendicular (normal) to the surface of the developing sleeve 41) is set to 100 mT. In this embodiment, the roller magnet 42 also has poles N1, N2, N3, and S2 in addition to the developing magnetic pole S1. The poles N1, N2, and N3 are the N pole of the magnet, and the poles S1 and S2 are the S pole of the magnet.

As the developing sleeve 41 is rotated, the developing agent is lifted onto the developing sleeve 41 at the pole N2, transported to the pole N1 while being regulated by the developing blade 47, and forms a thin layer. Subsequently, the developing agent on the chains standing in the magnetic field from the developing magnetic pole S1 develops the electrostatic image on the photosensitive drum 1. As the pole N3 and the pole N2 magnetically repel each other, the developing agent on the developing sleeve 41 falls into the development chamber $R_1$. The developing agent falling into the development chamber $R_1$ is mixed and transported with the first transporting screw 45 and the second transporting screw 46.

[Two-component Developing Agent]

The two-component developing agent used in this embodiment will now be described in further detail.

Toner

As the toner, a known toner containing a binder resin and an additive such as a coloring agent, a charge controlling agent, or the like can be used. The toner preferably has a volume-average particle diameter of 5 μm to 15 μm. In this embodiment, a toner having a volume-average particle diameter of 6 μm is used for all colors, LC, LM, C, M, Y, and Bk.

The light-colored toner is prepared such that the optical density after fixing is less than 0.8 when the amount of toner loaded on the transfer material S is 0.5 mg/cm$^2$. In this embodiment, the LC toner and the LM toner are each prepared by adjusting the pigments such that the optical density after fixing is 0.7 when the amount of the toner loaded on the transfer material S is 0.5 mg/cm$^2$. The dark-colored toners are each adjusted such that the optical density is at least 1.2 after fixing when the amount of toner on the transfer material S is 0.5 mg/cm$^2$. In this embodiment, the pigments in the DC, DM, Y, and Bk toners are adjusted such that the optical density after fixing is 1.4 when the amount of toner on the transfer material S is 0.5 mg/cm$^2$.

An appropriate external additive may be added to the toner if necessary. The external additive preferably has a particle diameter at most one tenth of the weight-average particle diameter of the toner particles from the standpoint of durability of the external additive. The particle diameter of the external additive is determined as the average particle diameter measured by microscopic surface observation of the toner particles. The external additive is used in an amount of 0.01 to 15 parts by weight and preferably 0.05 to 12 parts by weight per 100 parts by weight of the toner.

Examples of the external additive include metal oxides such as aluminum oxide, titanium oxide, strontium oxide, cerium oxide, magnesium oxide, chromium oxide, tin oxide, and zinc oxide; nitrides such as silicon nitride; carbide such as silicon carbide; metal salts such as calcium sulfate, barium sulfate, and calcium carbonate; fatty acid metal salts such as zinc stearate and calcium stearate; carbon black; and silica. These external additives may be used alone or in combination. The external additive is preferably hydrophobized.

The toner containing these components may be negatively or positively chargeable. In this embodiment, a negatively chargeable toner is used for all colors. In particular, a toner having an average charge quantity (charges per unit weight, also referred to "Q/M" hereinafter) of $-3.0\times10^{-2}$ C/kg from friction with the carrier is used for all colors. The mixing ratio (weight ratio) of the toner to the carrier is set to 8 wt % for all colors.

Here, the phrase "toner having the same hue but different density" means that the toner composed of a resin and a pigment contains a color-developing component (pigment) with the same spectral characteristics used in a different amount. The term "light-colored toner" indicates a toner with a relatively low density selected from among toners with the same hue but different densities. As described above, a toner prepared by controlling the pigment such that the optical density is less than 0.8 for a toner amount of 0.5 mg/cm$^2$ on the transfer material is preferably used as the light-colored toner. A toner prepared by controlling the pigment such that the optical density is 1.2 or more for a toner amount of 0.5 mg/cm$^2$ on the transfer material is preferably used as the dark-colored toner. Here, the phrase "same hue" means that the spectral characteristics of the color-developing components (pigment) are the same. However, the spectral characteristics need not be strictly the same, and the toners can be considered to have the "same hue" so long as their spectral characteristics fall into the same general category of colors, such as magenta, cyan, yellow, and black.

Carrier

A description of the carrier will now be provided. Formula (1) below is an approximation indicating the magnetic force applied from the developing magnetic pole to the magnetic carrier on the surface of the developing agent-bearing member, i.e., the magnetic binding force between the developing magnetic pole and the carrier. The term "magnetic binding force" is a force generated along the direction of the magnetic field formed by a magnetic pole. Formula (1) shows that the magnetic binding force is determined from the volume of the carrier, the magnetization of the carrier, and the magnetic field applied to the carrier. Note that when the developing magnetic pole is opposite to the developing region, the component of the magnetic binding force working in the perpendicular direction relative to the surface of the developing sleeve becomes the largest. This is optimum for preventing carrier adhesion.

$$F = (M \cdot \nabla)H \tag{1}$$

$$M = V \cdot J_m = \frac{4\pi r^3}{3} J_m$$

F: magnetic binding force [N]

M: magnetic moment [Am$^2$]

H: magnetic field applied to carrier [A/m]

V: volume of carrier [m$^3$]

Jm: magnetization [A/m]

The carrier adhesion on the image region tends to occur more severely during development of a high-density toner image with a large potential difference Vcont. In comparison with development with a dark-colored toner, development with a light-colored toner suffers from carrier adhesion onto the image region more frequently. The present invention prevents carrier adhesion on the image region during development with a light-colored toner while suppressing roughness in both the dark-colored toner image and the light-colored toner image in forming an image using at least the light-colored toner and the dark-colored toner having the same hue.

In this embodiment, from the standpoint of increasing the intensity of the magnetization of the carrier, the intensity of the magnetization of the carrier (carrier for light-colored toner) used in a developer using the light-colored toner is controlled to be higher than the intensity of the magnetization of the carrier (carrier for dark-colored toner) used in a developer using the dark-colored toner. In this manner, the magnetic binding force between the developing magnetic pole and the carrier can be increased, and the carrier adhesion on the image region at the developing region using the light-colored toner can be decreased. In other words, in this embodiment, the magnetic binding force working from the roller magnet 42 to the magnetic carrier on the surface of the developing sleeve 41 in the developing region of the developer for light-colored toner is larger than that of the developer for dark-colored toner.

Table 1 shows the relationships between the magnetization of the carrier, the carrier adhesion, and the roughness for the developer 4*a* for LC toner and the developer 4*c* for DC toner when the number-average particle diameter of the carrier is 40 μm. The same results are observed in the developer 4*b* for LM toner and the developer 4D for DM toner.

In Table 1, roughness was evaluated using a line image with a density of about 0.4 and 200 lines/inch. Previous sensory examination already revealed that roughness was particularly noticeable at a density of about 0.3 to 0.5 under human eyes. Carrier adhesion was confirmed by observation of voids and fixing defects (micro nonuniformity in gloss levels) in the image after fixing.

TABLE 1

| Carrier for light-colored toner (particle diameter: 40 μm) | | | Carrier for dark-colored toner (particle diameter: 40 μm) | | |
|---|---|---|---|---|---|
| Magnetization (kA/m) | Roughness | Carrier adhesion | Magnetization (kA/m) | Roughness | Carrier adhesion |
| 60 | A | X | 60 | A | X |
| 90 | A | X | 90 | A | X |
| 120 | A | X | 120 | A | Y |
| 150 | A | X | 150 | A | Z |
| 180 | A | Y | 180 | A | Z |
| 210 | A | Z | 210 | B | Z |
| 240 | A | Z | 240 | C | Z |
| 270 | A | Z | 270 | D | Z |
| 300 | B | Z | 300 | E | Z |
| 330 | C | Z | 330 | E | Z |

A: No roughness, highly smooth image
B: No roughness, smooth image
C: Little roughness, but still smooth image
D: Noticeable roughness
E: Highly noticeable roughness
X: Number of adhering particles was more than $1/cm^2$
Y: Number of adhering particles was $0.2/cm^2$ to $1/cm^2$
Z: Number of adhering particles was less than $0.2/cm^2$.

The results in Table 1 show that, for example, the intensity of the magnetization of the carrier of the light-colored toner should be adjusted to 210 kA/m or more in an external magnetic field of 79.8 kA/m when the number-average particle diameter of the carrier is 40 μm. The intensity of the magnetization of the carrier of the dark-colored toner should be adjusted to 150 kA/m or more at an external magnetic field of 79.8 kA/m when the number-average particle diameter of the carrier is 40 μm. In this manner, carrier adhesion onto the image region can be substantially prevented during development using the dark-colored toner and during development using the light-colored toner.

As previously described, when the magnetization of the carrier is intensified, the carrier chains formed in the developing region will have an increased strength and disturb the image region on the photosensitive drum 1, thereby increasing the roughness. This phenomenon occurs during development with the dark-colored toner as well as development with the light-colored toner. In this regard, the upper limit of the magnetization of the carrier for the dark-colored toner is considered to be the same as that of the carrier for the light-colored toner.

However, as shown in Table 1, when the light-colored toner is used, a satisfactorily smooth image is obtained with a carrier with a higher magnetization than in the case of using the dark-colored toner. This is presumably due to the following two factors.

The first factor is that the density of the toner itself is lower in the light-colored toner than in the dark-colored toner. Although the disturbance of the toner image occurs to the same extent in the light-colored toner image and the dark-colored toner image in the same density zone, the roughness in the light-colored toner image is less noticeable. This is because the difference in density between the light-colored toner containing the toner at a lower density and the transfer material S is small. Therefore, during development using the light-colored toner, a moderate degree of disturbance in the toner image resulting from an increased strength of the carrier chains does not significantly increase roughness of the image.

Figure 3:
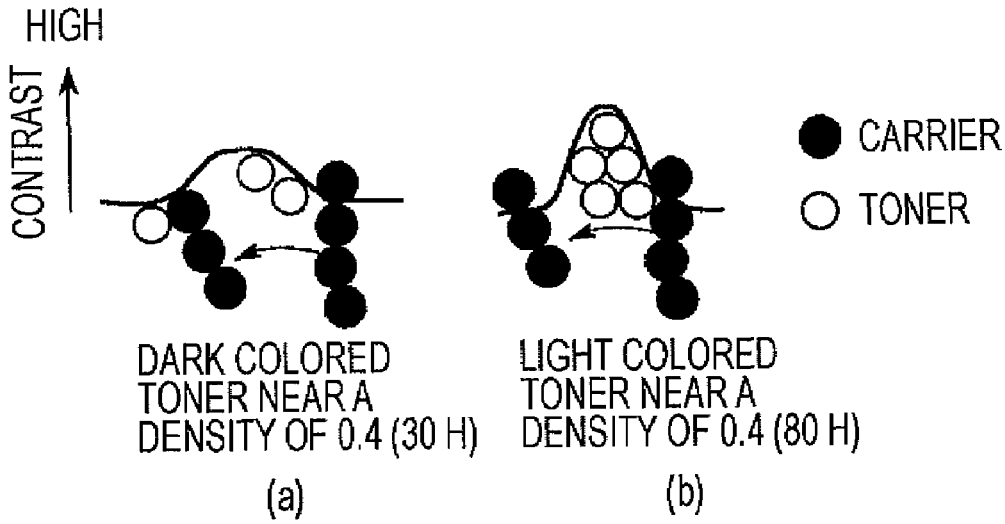
FIG. 3 is a schematic diagram for describing latent image distributions of a dark-colored toner and a light-colored toner at a density of about 0.4.

The second factor is that the image signal level, i.e., the latent image level, for the light-colored toner is higher than that for the dark-colored toner in obtaining images of the same density. In order to adjust the light-colored toner to exhibit a density of 0.4 at which roughness is particularly noticeable, the image output level is adjusted to 110 to 120 h, i.e., an intermediate-high density level. As shown in part (b) of FIG. 3, the latent image distribution is substantially as sharp as that of a digital latent image, and the latent image contrast is high. Thus, the toner image on the photosensitive drum 1 is strongly electrically confined by the latent image potential Therefore, it is difficult to disturb the image by the stress from the carrier chains. In contrast, in order to adjust the dark-colored toner to exhibit a density of 0.4 at which roughness is particularly noticeable, the image output level is adjusted to 30 to 40 h, i.e., a low-density level or a highlight image output level. The latent image distribution in such a case is broad as in an analog image shown in part (a) of FIG. 3. Thus, the electrical binding force from the latent image potential is small toward the toner image on the photosensitive drum 1, and the toner image is easily disturbed by the friction with the carrier chains. In other words, in the density zone where roughness is particularly noticeable, the light-colored toner image on the photosensitive drum 1 is more difficult to disturb than the dark-colored toner image. Thus, a light-colored toner image exhibits roughness equal to or higher than that of a dark-colored toner image even when a carrier with a larger magnetization is used with the light-colored toner and the frictional force against the image surface is thereby moderately increased by the carrier chains having an increased strength.

Because of the first and second factors described above, the roughness of a toner image formed by the light-colored toner is not significantly increased by using a carrier with a larger magnetization in the developer for light-colored toner when compared with the roughness of a toner image formed by the dark-colored toner.

This principle equally applies to the relationship between any two toners with the same hue and different densities, such as the relationship between the DC toner and the LC toner and the relationship between the DM toner and the LM toner.

In order to reduce carrier adhesion in the image region during development with the light-colored toner, the magnetization of the carrier for the light-colored toner is preferably larger than that of the carrier for the dark-colored toner.

The results in Table 1 show that the magnetization of the carrier for the light-colored toner at an external magnetic field or 79.58 kA/m is preferably 210 kA/m to 270 kA/m when the number-average particle diameter of the carrier is 40 μm. The results also show that the magnetization of the carrier for the dark-colored toner at an external magnetic field or 79.58 kA/m is preferably 150 kA/m to 180 kA/m when the number-average particle diameter of the carrier is 40 μm.

Any known carrier may be used as the carrier. An example thereof is a resin carrier containing a resin, magnetite (magnetic material) dispersed in the resin, and a conductive material (e.g., carbon black) dispersed in the resin to impart conducting property and adjust resistance. Other examples include a magnetite, such as a ferrite, subjected to surface oxidation and reduction to adjust resistance and a magnetite, such as ferrite, coated with a resin to adjust resistance. These carriers may be prepared by known processes. The present invention does not particularly limit the process of preparing carriers. In order to change the magnetization of the carrier, e.g., a resin carrier described above, the amount of magnetite in the entire amount of carrier is adjusted or a magnetite with a different magnetization is used, for example.

The resistivity of the carrier is preferably $10^8$ Ωcm to $10^{13}$ Ωcm at a field intensity of $5\times10^4$ V/m. When the resistivity of the carrier is excessively low, the negative charges may be injected into the electrostatic image on the photosensitive drum 1 through the carrier chains during development and the electrostatic image may be thereby disturbed. At an excessively high resistivity, the latent image on the photosensitive drum 1 may not be satisfactorily developed by the toner, resulting in a decrease in density.

As described above, in this embodiment, the magnetization of the carrier for the light-colored toner is adjusted to be larger than the magnetization of the carrier for the dark-colored toner. In this manner, the magnetic binding force between the carrier and the developing sleeve 41 in the developing region for the light-colored toner can be increased. Accordingly, carrier adhesion on the image region, which has been frequently observed during development with the light-colored toner, can be suppressed. Moreover, since only the magnetization of the carrier for the light-colored toner that does not cause a significant increase in roughness is intensified, image failures such as high roughness is prevented in both a dark-colored toner image and a light-colored toner image.

Accordingly, in the process of forming an image using two types of toners, i.e., a light-colored toner and a dark-colored toner, having the same hue according to this embodiment, an increase in roughness can be suppressed in both a dark-colored toner image and a light-colored toner image and carrier adhesion on the image region during development with the light-colored toner can be prevented.

Note that although in this embodiment the magnetic binding force between the developing magnetic pole and the carrier is adjusted by adjusting the magnetization of the carrier, it is possible to change the magnetic binding force by changing the volume of the carrier, i.e., the particle diameter of the carrier, as obvious from Formula (1) above. For example, as shown in Table 2, when the carrier for the light-colored toner and the carrier for the dark-colored toner both have a magnetization of 180 kA/m at an external magnetic field of 79.58 kA/m, the carrier particle diameter is preferably as follows.

TABLE 2

| Carrier for light-colored toner (σ 1000 180 kA/m) | | | Carrier for dark-colored toner (σ 1000 180 kA/m) | | |
|---|---|---|---|---|---|
| Carrier particle diameter (μm) | Roughness | Carrier adhesion | Carrier particle diameter (μm) | Roughness | Carrier adhesion |
| 30 | A | X | 30 | A | X |
| 36 | A | X | 36 | A | Z |
| 38 | A | X | 38 | A | Z |
| 40 | A | Y | 40 | A | Z |
| 42 | A | Z | 42 | B | Z |
| 45 | A | Z | 45 | C | Z |
| 47 | A | Z | 47 | E | Z |
| 50 | C | Z | 50 | E | Z |

A: No roughness, highly smooth image
B: No roughness, smooth image
C: Little roughness, but still smooth image
D: Noticeable roughness
E: Highly noticeable roughness
X: Number of adhering particles was more than $1/cm^2$
Y: Number of adhering particles was $0.2/cm^2$ to $1/cm^2$
Z: Number of adhering particles was less than $0.2/cm^2$.

The number-average particle diameter of the carrier for the light-colored toner is preferably about 42 to 47 μm, and that of the carrier for the dark-colored toner is preferably about 36 to 40 μm.

Second Exemplary Embodiment

A second embodiment of the present invention will now be described. The basic features and operation of the image-forming apparatus of the second embodiment are the same as those of the first embodiment. Thus, components having the same or similar functions and features are represented by the same reference numerals as those in the first embodiment, and the detailed description thereof is omitted to highlight the features characteristic of the second embodiment.

In the first embodiment, the magnetic binding force between the developing magnetic pole and the carrier is increased by changing the magnetization of the carrier. A similar effect can be attained by increasing the magnetic binding force by other means.

For example, in this embodiment, the magnetic binding force between the developing magnetic pole and the carrier is changed by changing the magnetic flux density of the developing magnetic pole, i.e., the magnetic flux density in the direction perpendicular (normal) to the surface of the developing sleeve 41.

Figure 4:
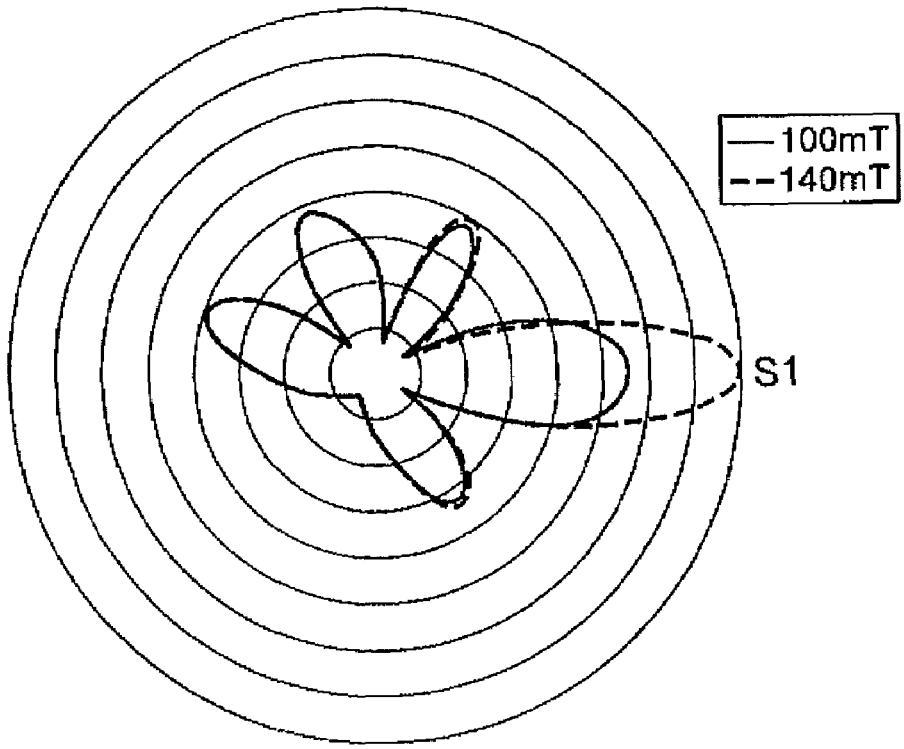
FIG. 4 is a graph for explaining a magnetic flux density distribution of a developing magnetic pole according to the invention.

FIG. 4 shows magnetic flux density distributions of the roller magnets 42 fixed in the developing sleeves 41 in a developer for a dark-colored toner and a developer for a light-colored toner according to this embodiment. In the drawing, the dotted line shows the distribution in the developer for the light-colored toner and the solid line shows the distribution in the developer for the dark-colored toner.

The magnetic flux density of the developing magnetic pole S1 in the developer for the light-colored toner is 140 mT, and that in the developer for the dark-colored toner is 100 mT.

Of the five magnetic poles of the roller magnet 42 in the developing sleeve 41, four magnetic poles other than the developing magnetic pole are made the same between the developer for the dark-colored toner and the developer for the light-colored toner.

In this embodiment, the half-value width (detailed description is given below) of the magnetic flux density of the developing magnetic pole is 40° in both the developer for the dark-colored toner and the developer for the light-colored toner. In order to increase the magnetic flux density, the developing magnetic pole of the developer for the light-colored toner is preferably composed of a rare earth magnet. In this embodiment, a neodymium magnet is used as the developing magnetic pole of the developer for the light-colored toner.

In this manner, since the magnetic binding force between the developing magnetic pole and the carrier is increased in the developing region using the light-colored toner, carrier adhesion can be suppressed in the developer for the light-colored toner in which carrier adhesion on the image region is frequent, as described in the first embodiment.

When the magnetic flux density of the developing magnetic pole is increased, the carrier chains exhibit a higher strength. There is a possibility of an increase in smoothness of the image on the photosensitive drum 1 by friction with the carrier chains.

However, as described in the first embodiment, since the density of the light-colored toner itself is lower than that of the dark-colored toner, the roughness is not easily noticeable. Moreover, the light-colored toner image on the photosensitive drum 1 in the density zone at which roughness is readily noticeable is strongly electrically bound by the latent image potential and is not easily disturbed. Because of these reasons, even when the magnetic flux density of the developing pole of the developer for the light-colored toner is made larger than that of the developer for the dark-colored toner, image defects such as increased roughness are prevented, and carrier adhesion on the image region during development with the light-colored toner can be effectively decreased.

Table 3 shows the relationship between the magnetic flux density of the developing magnetic pole, carrier adhesion, and occurrence of roughness in the developer 4*a* for the LC toner and the developer 4*c* for the DC toner. The same carrier was used in both the developers 4*a* and 4*c*. The number-average particle diameter of the carrier was 40 μm, and the magnetization at an external magnetic field of 79.85 kA/m was 180 kA/m. The same relationship was observed for the developer 4*b* for the LM toner and the developer 4*d* for the DM toner.

TABLE 3

| Developer for light-colored toner | | | Developer for dark-colored toner | | |
|---|---|---|---|---|---|
| Magnetic flux density (mT) | Smoothness | Carrier adhesion | Magnetic flux density (mT) | Smoothness | Carrier adhesion |
| 70 | A | X | 70 | A | X |
| 80 | A | X | 80 | A | Z |
| 100 | A | Y | 100 | A | Z |
| 120 | A | Z | 120 | B | Z |
| 140 | A | Z | 140 | C | Z |
| 160 | B | Z | 160 | E | Z |

A: No roughness, highly smooth image
B: No roughness, smooth image
C: Little roughness, but still smooth image
D: Noticeable roughness
E: Highly noticeable roughness
X: Number of adhering particles was more than 1/cm$^2$
Y: Number of adhering particles was 0.2/cm$^2$ to 1/cm$^2$
Z: Number of adhering particles was less than 0.2/cm$^2$.

The results in Table 3 show that the magnetic flux density of the developing magnetic pole in the developer for the light-colored toner is preferably 120 mT to 140 mT when the number-average particle diameter of the carrier is 40 μm and the magnetization of the carrier at an external magnetic field of 79.58 kA/m is 180 kA/m, for example. The magnetic flux density of the developing magnetic pole in the developer for the dark-colored toner is preferably 80 mT to 100 mT when the number-average particle diameter of the carrier is 40 μm and the magnetization of the carrier at an external magnetic field of 79.58 kA/m is 180 kA/m, for example.

As is described above, in this embodiment, the magnetic flux density of the developing magnetic pole of the developer for the light-colored toner is adjusted to be higher than that of the developer for the dark-colored toner. In this manner, the magnetic binding force between the carrier and the developing sleeve 41 in the developing region using the light-colored toner can be increased. Thus, carrier adhesion on the image region which frequently occurs during development with the light-colored toner can be suppressed. Moreover, image defects such as high roughness can be prevented.

Third Exemplary Embodiment

A third embodiment of the present invention will now be described. The basic features and operation of the image-forming apparatus of the third embodiment are the same as those of the first embodiment. Thus, components having the same or similar functions and features are represented by the same reference numerals as those in the first embodiment, and the detailed description thereof is omitted to highlight the features characteristic of the third embodiment.

In this embodiment, in order to adjust the magnetic bonding force between the developing magnetic pole and the carrier in the developing region using the light-colored toner to be larger than the magnetic binding force at the developing region using the dark-colored toner, the half-value width of the magnetic flux density of the developing magnetic pole of the developer for the light-colored toner is made different from that of the developer for the dark-colored toner.

Figure 5A:
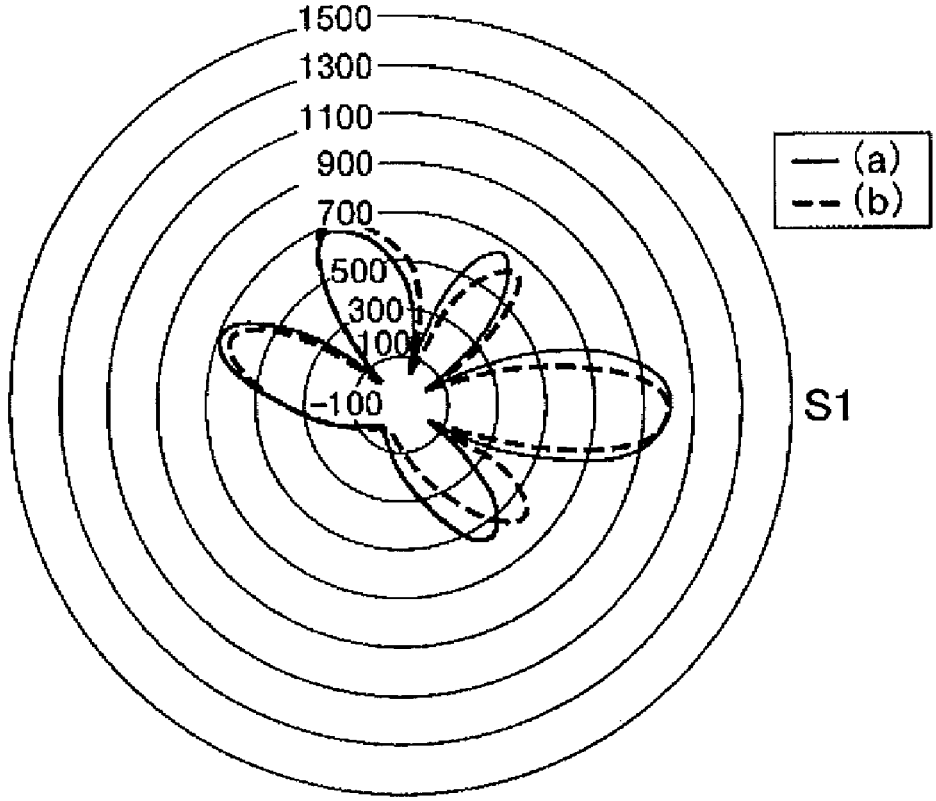
FIGS. 5A and 5B are graphs for explaining a magnetic flux density distribution of a developing magnetic pole according to the invention.
Figure 5B:
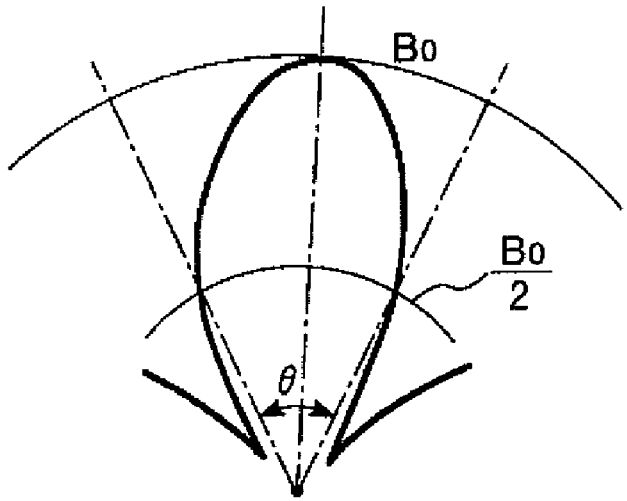
Figure 6:
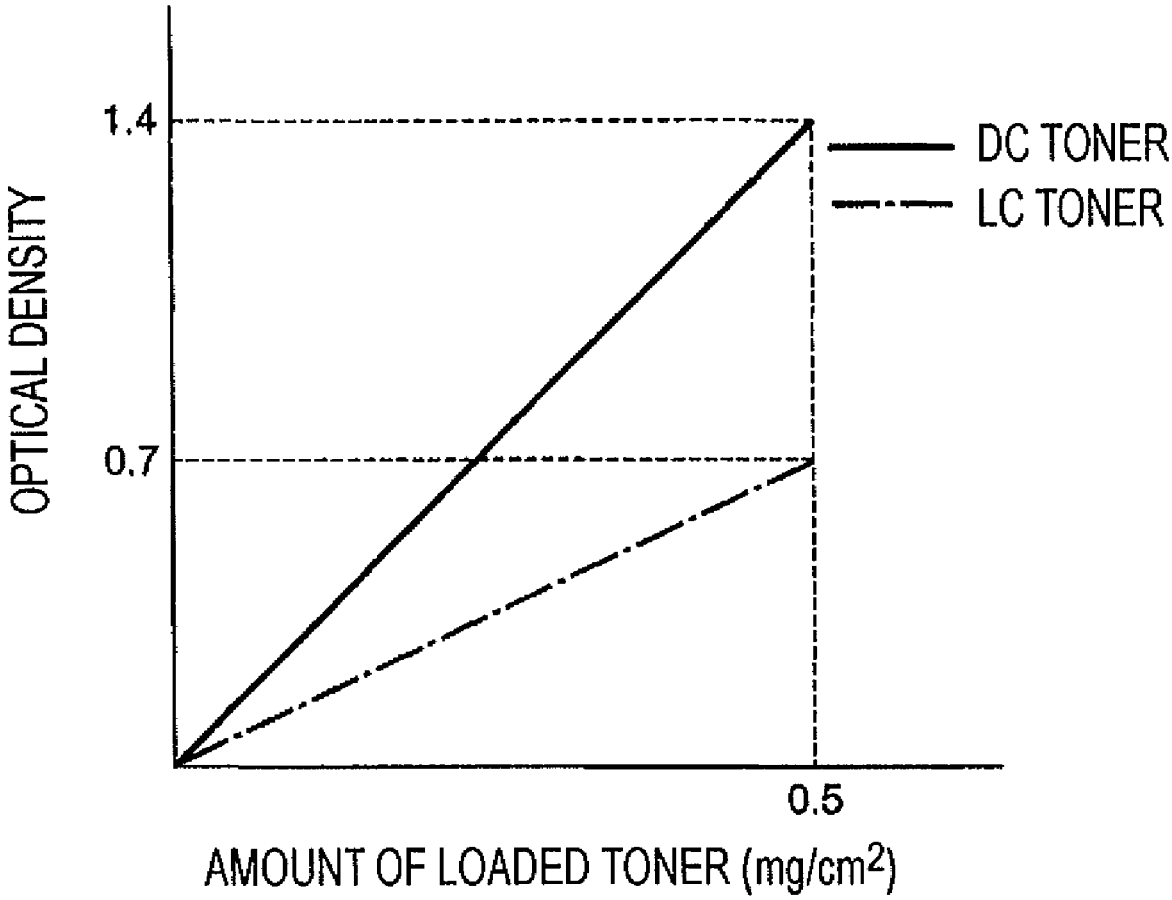
FIG. 6 (PRIOR ART)
FIG. 6 is a graph showing covering power of a light cyan toner (LC toner) and dark cyan toner (DC toner).

Half-value width is the angle θ (°) defined by the two positions indicating half values ($B_0/2$) at the two sides of the maximum magnetic flux density ($B_0$), as shown in FIG. 5A.

Formula (2) below is an expansion of formula (1) above with magnetic flux density. As described in the first embodiment, the magnetic binding force between the developing magnetic pole and the carrier is approximately expressed by formula (2). Formula (2) indicates that the magnetic binding force F increases with the amount of change in magnetic flux density $B_0$ of the developing magnetic pole.

$$F = \frac{1}{\mu_0}\frac{3(\mu-1)}{\mu+2}\frac{4\pi r^3}{3}(B_0\cdot\nabla)B_0 \quad (2)$$

F: magnetic binding force [N]
$B_0$: magnetic flux density [T]
r: carrier particle diameter [m]
μ: relative magnetic permeability In this embodiment, the half-value width of the magnetic flux density (magnetic flux density in the direction perpendicular (normal) to the surface of the developing sleeve 41) is adjusted to be smaller in the region where the image is developed with the light-colored toner than in the region where the image is developed with the dark-colored toner. In this manner, the magnetic bonding force between the developing magnetic pole and the carrier can be increased in the developer for the light-colored toner.

For example, the magnetic flux density distribution of the magnetic field from the developing magnetic pole of the developer for the light-colored toner is controlled as indicated by a broken line (b) in FIG. 5A. The magnetic flux density distribution indicated by (b) in FIG. 5A has a half-value width of 30°. In contrast, the magnetic flux density distribution of the magnetic field from the developing magnetic pole of the developer for the dark-colored toner is controlled as indicated by a solid line (a) in FIG. 5A. Here, the half-value width is 40°. The magnetic flux density of the magnetic field from the developing magnetic pole is 100 mT in both the developers.

In this manner, the magnetic binding force in the region where the image is developed with the light-colored toner becomes larger than that in the region where the image is developed with the dark-colored toner. Thus, the same effects described in the first and second embodiments can be achieved.

[Measurement Methods]

The resistivity of the magnetic carrier is measured as follows. First, a magnetic carrier or core particles are filled in a cell. Two electrodes are disposed at opposing ends such that the electrodes contact the magnetic carrier or the core particles. Voltage is applied between the electrodes, and the current flowing therebetween is measured to determine resistivity. The resistivity is measured under the following conditions: the contact area S between the magnetic carrier or core particles and the electrodes is about 2.3 $cm^2$; the thickness d is about 2 mm; the load of the upper electrode is 180 g; and the measuring electric field intensity is $5\times10^4$ V/m.

The average particle diameter of the carrier is measured as follows. The maximum chord length in the horizontal direction is assumed to be the carrier particle diameter. Using a scanning electron microscope (magnification: 100× to 5,000×), 300 or more carrier particles with a particle diameter of 0.1 μm or more are selected at random, and the diameter of these particles is measured. The arithmetic mean of the particle diameter is defined to be the carrier particle diameter of the present invention.

The magnetic properties of the magnetic carrier are measured with a vibration magnetic field-type magnetic property recorder BHV-30 manufactured by Riken Denshi Co., Ltd. The magnetic characteristic values of the powdery magnetic carrier are measured in external magnetic fields of 795.7 kA/m and 79.58 kA/m to determine the magnetization intensity of the magnetic carrier. A measurement sample of the magnetic carrier is prepared by sufficiently closely packing a cylindrical plastic container with the magnetic carrier. The magnetic moment in this state is measured, and the mass of the sample was weighed to determine the magnetization intensity (A/m). The true specific gravity of magnetic carrier particles is measured with, for example, dry-type automatic densimeter Accupyc 1330 (produced by Shimadzu Corporation). The magnetization intensity per unit volume can be determined as a product of the magnetization intensity and the true specific gravity measured as above.

The magnetic flux distributions of the developing magnetic pole S1 and other magnetic poles N1, N2, N3, and S2 of the fixed magnet in the developing sleeve are measured with gaussmeter 640 produced by F. W. Bell. The developing sleeve is horizontally fixed, and an axial probe is horizontally fixed while maintaining a very small distance (set to about 100 μm during the measurement) from the surface of the developing sleeve so that the center of the developing sleeve and the center of the probe are on substantially the same horizontal plane. The probe is connected to the gaussmeter, and the magnetic flux density on the surface of the developing sleeve is measured. The development sleeve and the magnet are substantially concentric, and the space between the developing sleeve and the magnet can thus considered to be the same at any position. Accordingly, the magnetic flux density Br in the direction normal to the surface of the developing sleeve can be measured for all positions in the circumferential direction.

The volume-average particle diameter of the toner can be measured by the following measurement method, for example. A measuring instrument, Coulter Counter TA-II (produced by Beckman Coulter, Inc.), is connected to an interface (produced by Nikkaki-Bios) and CX-i personal computer (produced by Canon Corporation) to output number-average distribution and volume-average distribution. A 1% NaCl aqueous solution prepared from extra pure sodium chloride is used as the electrolyte. To 100 to 150 ml of this aqueous electrolyte, 0.1 to 5 ml of a surfactant (preferably alkyl benzene sulfonate) serving as a dispersant and 0.5 to 50 mg of a measurement sample are added. The resulting electrolyte with the sample suspended therein is subjected to dispersion treatment for about 1 to 3 minutes in an ultrasonic disperser, and the particle-size distribution of 2 to 40 μm particles is measured with 100 μm apertures and the Coulter Counter TA-II to determine the volume distribution. The volume-average particle diameter is calculated from the resulting volume distribution.

Although the present invention is described above by way of specific embodiments, the present invention is not limited by these embodiments. For example, in the first to third embodiments, the image-forming apparatus employs an intermediate transfer method. However, application of the present invention is not limited to this method, and the present invention is equally applicable to image-forming apparatuses of a direct transfer type widely known to skilled persons. An image-forming apparatus of a direct transfer type includes, for example, a transporting belt as a member for carrying and transferring the transfer material. The toner images respectively formed on the image-bearing members disposed along the moving direction of the surface of the transporting belt are sequentially superimposed on the transfer material on the transporting belt to thereby form an image composed of toners of different colors.

Another image-forming apparatus known to skilled persons includes a plurality of developers for one image-bearing member, in which toner images are formed on the image-bearing member and transferred to a transfer material, either directly or indirectly via an intermediate transfer material, one after another. The present invention is equally applicable to such an image-forming apparatus.

This application claims the benefit of Japanese Application No. 2003-280460 filed Feb. 23, 2006, which is hereby incorporated by reference herein in its entirety.

What is claimed:

1. An image-forming apparatus, comprising:

a first developer container accommodating a first developing agent containing a first toner and a first carrier;

a first developing agent-bearing member that is associated with the first developer container and carries and transports the first developing agent to a first developing region to develop an electrostatic image;

first magnetic field-generating means for generating a magnetic field in the first developing region, the first magnetic field-generating means being disposed in the first developing agent-bearing member;

a second developer container accommodating a second developing agent containing a second toner and a second carrier, the second toner having the same hue as that of the first toner but a density lower than that of the first toner;

a second developing agent-bearing member that is associated with the second developer container and carries and transports the second developing agent to a second developing region to develop an electrostatic image; and second magnetic field-generating means for generating a magnetic field in the second developing region, the second magnetic field-generating means being disposed in the second developing agent-bearing member, wherein a magnetic binding force applied to the second carrier in the second developing region from the second magnetic field-generating means is larger than a magnetic binding force applied to the first carrier in the first developing region from the first magnetic field-generating means.

2. The image-forming apparatus according to claim 1, wherein:

the second toner has an optical density of less than 0.8 when the amount of the toner loaded on a transfer material is 0.5 mg/cm$^2$, and the first toner has an optical density of 1.2 or more when the amount of the toner loaded on a transfer material is 0.5 mg/cm$^2$.

3. The image-forming apparatus according to claim 1, the first magnetic field-generating means including a first magnetic pole at a position opposing the first developing region, and the second magnetic field-generating means including a second magnetic pole at a position opposing the second developing region, wherein a magnetic flux density of the second magnetic pole in the second developing region in the normal direction is larger than a magnetic flux density of the first magnetic pole in the first developing region in the normal direction.

4. The image-forming apparatus according to claim 3, wherein the second magnetic pole of the second magnetic field-generating means includes a rare-earth magnet.

5. The image-forming apparatus according to claim 1, the first magnetic field-generating means including a first magnetic pole at a position opposing the first developing region, the second magnetic field-generating means including a second magnetic pole at a position opposing the second developing region, wherein a half-value width of a magnetic flux density of the second magnetic pole in the second developing region is smaller than a half-value width of a magnetic flux density of the first magnetic pole in the first developing region.

6. The image-forming apparatus according to claim 1, wherein a magnetization intensity of the second carrier is greater than a magnetization intensity of the first carrier.

7. The image-forming apparatus according to claim 1, wherein a particle diameter of the second carrier is greater than a particle diameter of the first carrier.

* * * * *